US006209465B1

(12) United States Patent
Brooks

(10) Patent No.: US 6,209,465 B1
(45) Date of Patent: Apr. 3, 2001

(54) STABILIZING ARRANGEMENT

(76) Inventor: David Alan Brooks, P.O. Box 55163, Northlands, 2116, Gauteng (ZA)

( * ) Notice: Subject to any disclaimer, the term of this patent is extended or adjusted under 35 U.S.C. 154(b) by 0 days.

(21) Appl. No.: 09/194,548

(22) PCT Filed: Jun. 2, 1997

(86) PCT No.: PCT/GB97/01481

§ 371 Date: Mar. 30, 1999

§ 102(e) Date: Mar. 30, 1999

(87) PCT Pub. No.: WO97/45036

PCT Pub. Date: Dec. 4, 1997

(30) Foreign Application Priority Data

May 31, 1996 (ZA) ..... 96/4500

(51) Int. Cl.[7] ..... A47B 13/02
(52) U.S. Cl. ..... 108/150; 248/188.7
(58) Field of Search ..... 248/188.7, 354.2; 312/251.2; 297/461, 463.1, 445.1; 108/150, 161, 144.11, 147.19

(56) References Cited

U.S. PATENT DOCUMENTS 1,899,835 * 2/1933 Thum ..... 108/150 X
3,185,423 * 5/1965 Jones, III ..... 108/150 X
3,664,275 * 5/1972 Kleinert ..... 108/150
3,705,704 * 12/1972 Textoris ..... 248/188.7
3,814,362 * 6/1974 Ritchie ..... 248/188.3
4,406,437 * 9/1983 Wright ..... 248/188.7 X
5,690,303 * 11/1997 Winters ..... 248/188.7 X

* cited by examiner

*Primary Examiner*—Janet M. Wilkens
(74) *Attorney, Agent, or Firm*—Gifford, Krass, Groh, Sprinkle, Anderson & Citkowski, P.C.

(57) ABSTRACT

A stabilizing arrangement for use with a table, includes a support structure which is mountable to a table top. Four feet are mounted on the support structure so that a line drawn between a first pair of the feet intersects a line drawn between a second pair of the feet. The feet of each pair are fixed relative to each other and the pairs are linearly displaceable relative to each other. A displacement mechanism is arranged on the support structure to permit linear displacement of the pairs of feet relative to each other. The displacement mechanism is operable when the feet are placed on an uneven support surface so that all four feet can be against the support surface, in use.

14 Claims, 5 Drawing Sheets

STABILIZING ARRANGEMENT

THIS INVENTION relates to a stabilising arrangement. More particularly, this invention relates to a stabilizing arrangement for use with a table.

It is often a problem with tables having four feet that the feet do not all contact a support surface. This results in the table rocking on the support surface. This can occur on a planar support surface, such as a floor if the feet do not have four points of contact that define a plane. Alternatively, the four points of contact could define a plane but the support surface could be uneven. A particular example would be a restaurant table on a hard floor such as that which is tiled. If one of the feet slips into a crack between two tiles, the table will rock resulting in user irritation. An attempt to solve the former problem has been to utilise articles having three feet. A problem with this, however, is that the table tends to be unstable, especially when the table is top heavy, and tilts too easily. This invention provides a means whereby rocking is, to a large extent, eliminated without sacrificing the stability of the table.

In this specification, the word "table" is to be understood to mean any article or device for bearing a load.

According to the invention, there is provided a stabilizing arrangement for use with a table, the arrangement including

- a support structure, which is mountable to a table top being mountable on the support structure;
- four feet which are mounted on the support structure so that a line drawn between a first pair of the feet intersects a line drawn between a second pair of the feet, the feet of each pair being fixed relative to each other with the pairs being linearly displaceable relative to each other; and
- a displacement means arranged on the support structure which permits linear displacement of the pairs of feet relative to each other, when the feet are placed on an uneven support surface so that all four feet can bear against the support surface, in use; and
- a displacement limiting means which is operatively arranged with respect to the support structure and the feet and which is automatically frictionally operable to limit linear displacement of the pairs of feet relative to each other when all four feet bear against the support surface.

The support structure may include a first and a second support member. The support members may be linearly displaceable with respect to each other. The first pair of feet may be fixed to the first support member and the second pair of feet may be fixed to the second support member.

The first support member may be hollow. The second support member may be received within the first support member.

The first support member may have covering elements extending therefrom to cover the second pair of feet. The covering elements may have an appearance similar to that of the first pair of feet.

The first support member may be fastenable to the table top.

A mass of the second support member may be such that contact of the second pair of feet with the support surface is facilitated.

The arrangement may include a spring mounting means to permit the second support member to be spring mounted with respect to the table top to bias the second support member away from the table top.

The displacement means may be in the form of a lever mechanism which is arranged between the support members. The lever mechanism may be configured so that, on movement of one of the support members towards the table top, the other support member is urged away from the table top, and vice versa, in use.

The lever mechanism may include a lever. The lever member may be pivotally arranged, at one end, with respect to the first support member, and, at an opposed end, pivotally arranged with respect to the second support member. The lever mechanism may also include a fulcrum which is fastenable to the table top and which bears against the lever member at a position intermediate the ends of the lever member. Thus, substantially an entire load carried by the table top bears on the lever member, in use.

One end of the first support member may define a tapered surface. One corresponding end of the second support member may also define a tapered surface. The tapered surfaces may be configured so that, when the ends of the members are adjacent each other, the surfaces together define a formation having a substantially "V"-shaped profile which opens towards an underneath surface of the table top, in use.

Instead, a least one urging member may be located in the formation. The, or each, urging member may be configured so that, when a load is carried by the table top, on upward movement of the first member, the urging member bears against the tapered surface of the second member to urge the second member downwardly, and vice versa.

One urging member, in the form of a split ring, may be received in the formation.

Instead, a pair of urging members in the form of a pair of diametrically opposed spheres may be located in the formation.

Further, one urging member in the form of a deformable member may be located between the upper ends of the member and the underneath surface of the table top, in use.

The displacement limiting means may include at least one frictional engaging member which may be arranged on one of the support members. The, or each, frictional engaging member may project from said one of the support members so that, when the support members tilt relative to each other, the, or each, engaging member frictionally engages the other support member to inhibit linear displacement of the support members relative to each other.

Instead, the displacement limiting means may include at least one pin, which is attached to, and extends between opposed positions on the first support member. A pin may be received in each of one or more formations defined in the second support member. The, or each, pin and its associated formation may be configured so that linear displacement of the support members relative to each other is permitted when the support members are positioned substantially parallel to each other, but is inhibited when one of the support members is angled relative to the other support member.

The displacement limiting means may include two, spaced pins, a pin being received in each of a pair of spaced slots defined in the second support member.

The invention extends to a table which includes the stabilizing arrangement as described above.

Figure 1:
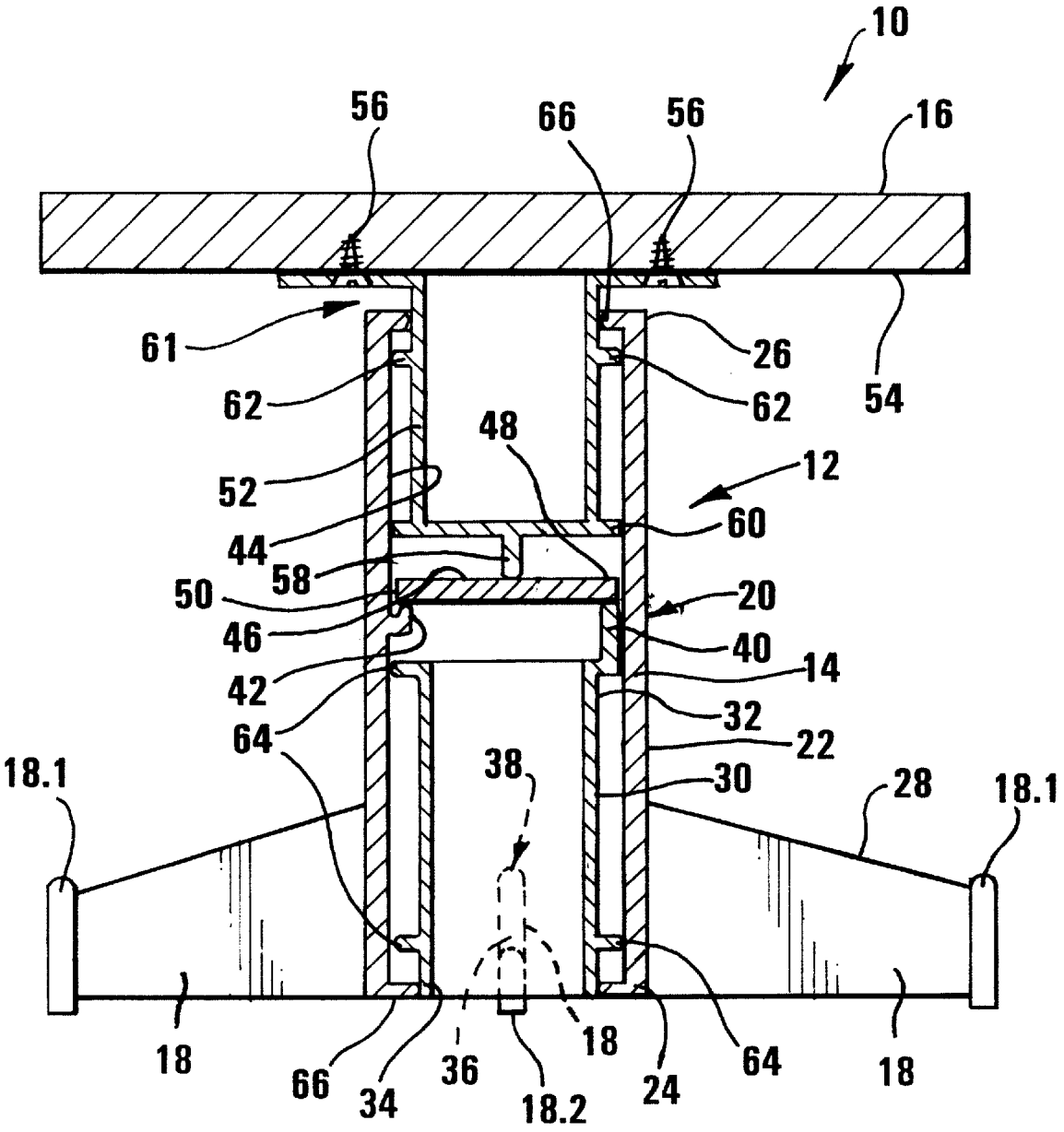
FIG. 1 shows a schematic sectioned side view of a table having one embodiment of a stabilizing arrangement according to the invention.

In FIG. 1, reference numeral 10 generally indicates a table which has one embodiment 12 of a stabilizing arrangement according to the invention.

The arrangement 10 includes a support structure 14. A table top 16 is mounted on the support structure 14.

The arrangement 12 includes four feet 18 which are mounted on the support structure 14. A line drawn between a first pair of feet 18.1 intersects a line drawn between a second pair of feet 18.2. The feet 18 of each pair are fixed relative to each other while the pairs are linearly displaceable relative to each other.

The stabilizing arrangement 12 includes a displacement means or mechanism 20. The mechanism 20 permits linear displacement of the pairs of feet 18 relative to each other. The mechanism 20 is operable when the feet 18 are placed on an uneven support surface (not shown) so that all four feet 18 can bear against the support surface.

The support structure 14 includes a first support member. The first support member is a sleeve 22. The sleeve 22 has an open lower end 24 and an open upper end 26. Each foot 18.1 is connected to the lower end 24 of the sleeve 22, via an arm 28.

The structure 14 includes a second support element. The second support element is a prop 30. The prop 30 has an upper end 32 and a lower end 34. Each foot 18.2 is connected to the prop 30 via an arm 36. Each arm 36 extends through an opening 38 defined in the sleeve 22.

A projection 40 extends from the upper end 32 of the prop 30. A ledge 42 is defined by an inner surface 44 of the sleeve 22. The position of the ledge 42 is diametrically opposed to the position of the projection 40.

A lever member or lever 46 is supported, at one end 48, on the projection 40. An opposed end 50 of the lever 46 is supported on the ledge 42. The projection 40 and the ledge 42 are positioned intermediate the lower and upper ends 24, 26 of the sleeve 22.

The arrangement 12 includes a carrier 52. The carrier 52 is fastened to an underneath surface 54 of the table top 16 via screws 56.

The carrier 52 extends into the sleeve 22. A fulcrum 58 is defined by a free end 60 of the carrier 52. The fulcrum 58 bears against the lever 46 intermediate the ends 48, 50 of the lever 46. A position of the lever 46 and a length of the carrier 52 are such that a gap 61 is provided between the upper end 26 of the sleeve 22 and the table top 16. It follows that a weight of the table top 16 and any items placed on the table top 16 is exerted on the lever 46.

In use, the table 10 is placed on the support surface. If one of the feet 18.1 is displaced upwardly as a result of a support surface being uneven, the sleeve 22 moves upwardly with respect to the prop 30. This causes pivotal, clockwise movement of the lever 46. Such movement results in a downward force being exerted on the prop 30 via the projection 40. In this manner, the second pair of feet 18.2 are urged into contact with the support surface to inhibit rocking of the table 10. Rocking resulting from upward displacement of one of the feet 18.2 is inhibited through pivotal, anti-clockwise movement of the lever 46.

it is undesirable that further linear movement of the carrier 52 relative to the sleeve 22 occurs when all four feet 18 bear against the support surface. Thus, the table 10 includes a displacement limiting device in the form of frictional engaging formations in the form of protuberances 62 defined on the carrier 52. The protuberances 62 are dimensioned and positioned on the carrier 52 so that angular relative movement of the carrier 52 and the sleeve 22 results in the protuberances 62 frictionally engaging an inner surface of the sleeve 22. It is also undesirable that excessive relative linear movement of the prop 30 and the sleeve 22 occurs when all four feet 18 bear against the support surface. Thus, the prop 30 has frictional engaging formations in the form of protuberances 64 defined thereon. The protuberances 64 are positioned and dimensioned frictionally to engage the inner surface of the sleeve 22 upon angular movement of the prop 30 relative to the sleeve 22.

The ends 24, 26 of the sleeve 22 each have an inwardly directed lip 66 defined thereon. When a user lifts the table 10 by gripping the table top 16, the lips 66 bear against the protuberances 66, 64, and inhibit dismantling of the table 10.

Figure 2:
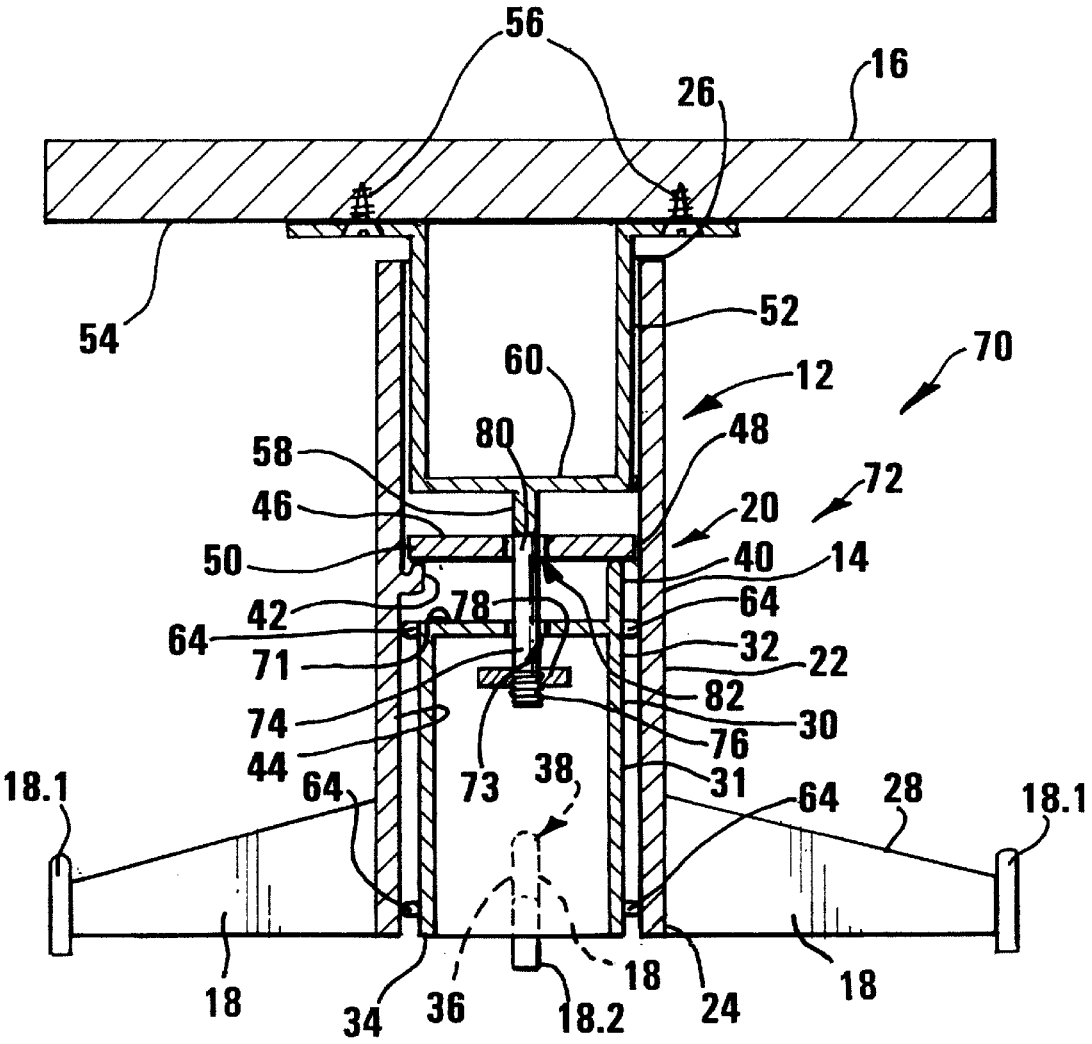
FIG. 2 shows a schematic, sectioned side view of a table having another embodiment of a stabilizing arrangement according to the invention.

In FIG. 2, reference numeral 70 generally indicates a table having another embodiment 72 of a stabilizing arrangement according to the invention. With reference to FIG. 1, like reference numerals refer to like parts, unless otherwise specified.

The prop 30 is hollow and has a cylindrical wall 31. An end wall 71 closes the upper end 32. An opening 73 is defined in the end wall 71.

A rod 74 is connected to the fulcrum 58 and extends through an opening 82 defined in the lever 46, which is in the form of a rocker-plate. The rod 74 also extends through the opening 73. A free end 76 of the rod 74 is threaded. The threaded end 76 is received through a retaining nut 78. The nut 78 is dimensioned to inhibit the rod 74 from being withdrawn through the openings 73, 82.

Thus, dismantling of the table 70 is inhibited when the table 70 is lifted.

Figure 3:
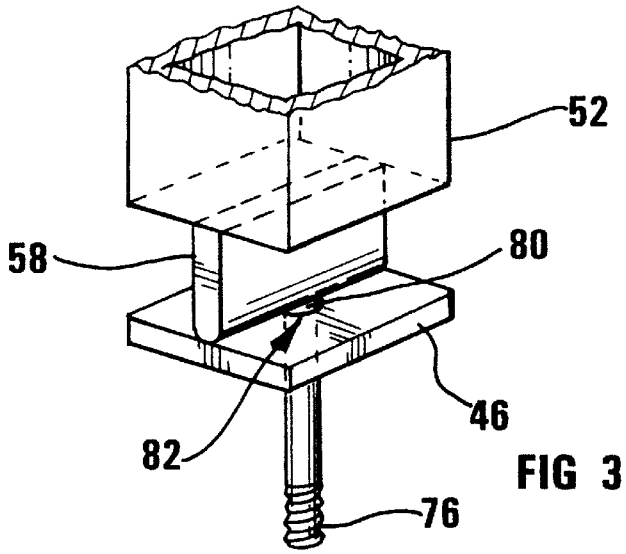
FIG. 3 shows a three dimensional view of a fulcrum of the stabilizing arrangement of FIG. 2.
Figure 4:
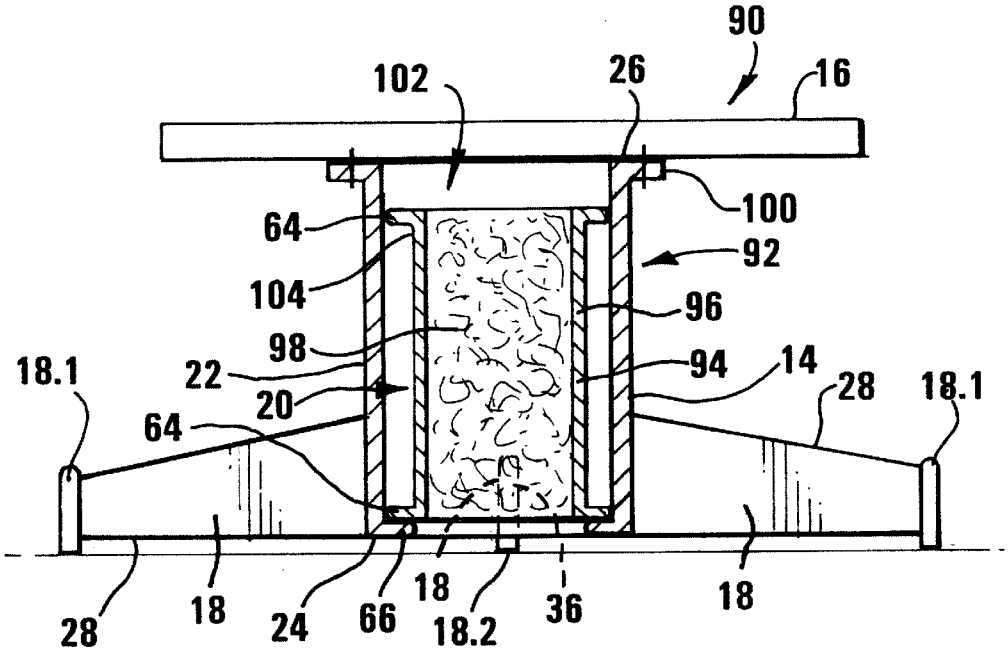
FIG. 4 shows a schematic, sectioned side view of a table having another embodiment of a stabilizing arrangement according to the invention.

In FIG. 4, reference numeral 90 generally indicates another embodiment 92 of a stabilizing arrangement according to the invention. With reference to FIGS. 1 to 3, like numerals refer to like parts, unless otherwise specified.

Instead of the carrier 52 and the prop 30, the arrangement 92 has a weight 94 positioned within the sleeve 22. The weight 94 comprises a hollow cylinder 96 and concrete 98 contained within the cylinder 96. The arms 36 are connected to the cylinder 96.

The table top 16 is fastened to a flange 100 defined by the upper end 26 of the sleeve 22. A gap 102 is provided between an upper end 104 of the weight 94 and the underneath surface 54 of the table top 16. The protuberances 64 are located on the cylinder 96 and operate in the manner described with reference to FIGS. 1 and 2, to inhibit relative linear movement of the sleeve 22 and the weighted member 94, when all four feet 18 bear against the support surface. The weighted member 94 serves to assist in ensuring the feet 18.2 remain in contact with the support surface. This has a stabilizing effect on the table 70.

Figure 5:
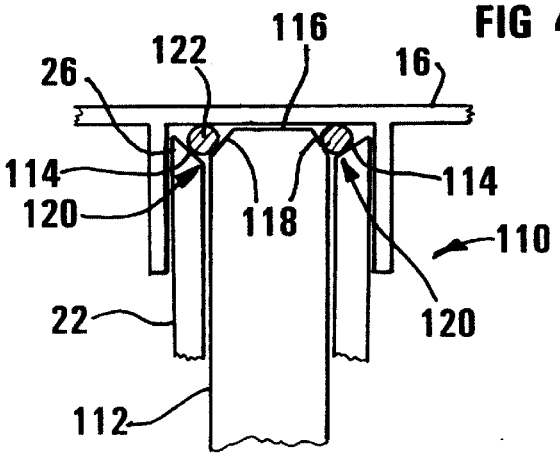
FIG. 5 shows a schematic side view of part of another embodiment of a stabilizing arrangement according to the invention.

In FIG. 5, reference numeral 110 generally indicates another embodiment of a stabilizing arrangement according to the invention.

The arrangement 110 includes the second support member which is in the form of a bar 112.

The upper end 26 of the sleeve 22 has a chamfered inner edge 114. An upper end 116 of the bar 112 has a chamfered edge 118. The edges 114, 118 are positioned together to define a formation 120 having a "V"-shaped profile. The profile opens towards the underneath surface 54 of the table top 16.

Figure 7:
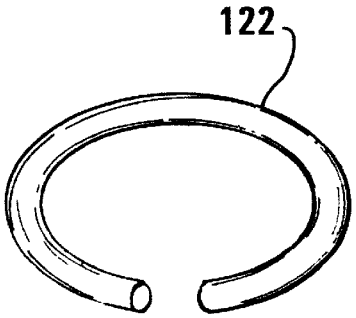
FIG. 7 shows an urging member of the arrangement of FIG. 5.

An urging member in the form of a split ring 122 (FIG. 7) is received in the formation 120. The split ring 122 is dimensioned so that the underneath surface 54 of the table top 16 bears against the split ring 122. Thus, when a load is carried by the table top 16, upward movement of the sleeve 22 causes the split ring 122 to close and to bear against the edge 118 of the bar 112. The bar 112 is thus urged downwardly. Upward movement of the bar 112 causes the ring 122 to open. The sleeve 22 is thus urged downwardly. The resultant relative displacement of the sleeve 22 and the bar 112 has a stabilising effect.

Figure 6:
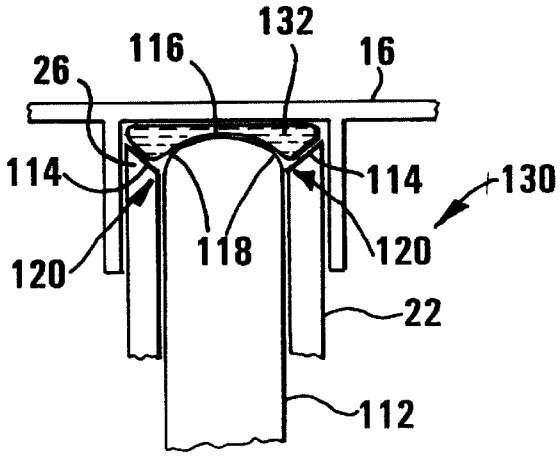
FIG. 6 shows a schematic side view of part of another embodiment of a stabilizing arrangement according to the invention.

In FIG. 6, reference numeral 130 generally indicates another embodiment of a stabilizing arrangement according to the invention. With reference to FIGS. 1 to 5, like reference numerals refer to like parts, unless otherwise specified.

The arrangement 130 is substantially the same as the arrangement 110. However, instead of the split ring 122, the arrangement 130 has a fluid-filled, flexible bag 132 positioned above the end 26 of the sleeve 22 and the end 116 of the bar 112 and below the underneath surface 54 of the table top 16.

Figure 8:
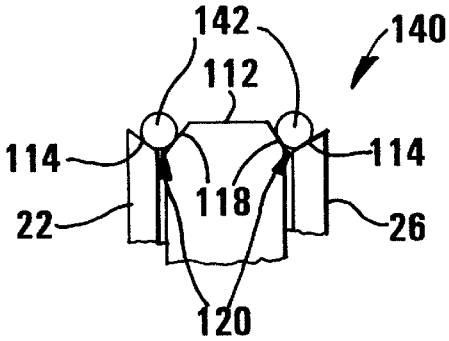
FIG. 8 shows a schematic side view of part of another embodiment of a stabilizing arrangement according to the invention.

In FIG. 8, reference numeral 140 generally indicates another embodiment of a stabilising arrangement according to the invention. With reference to FIGS. 1 to 7, like reference numerals refer to like parts, unless otherwise specified.

Instead of the split ring 122 or the fluid-filled bag 130, the arrangement 140 has a pair of diametrically opposed spheres 142 positioned in the formation 120.

Figure 9:
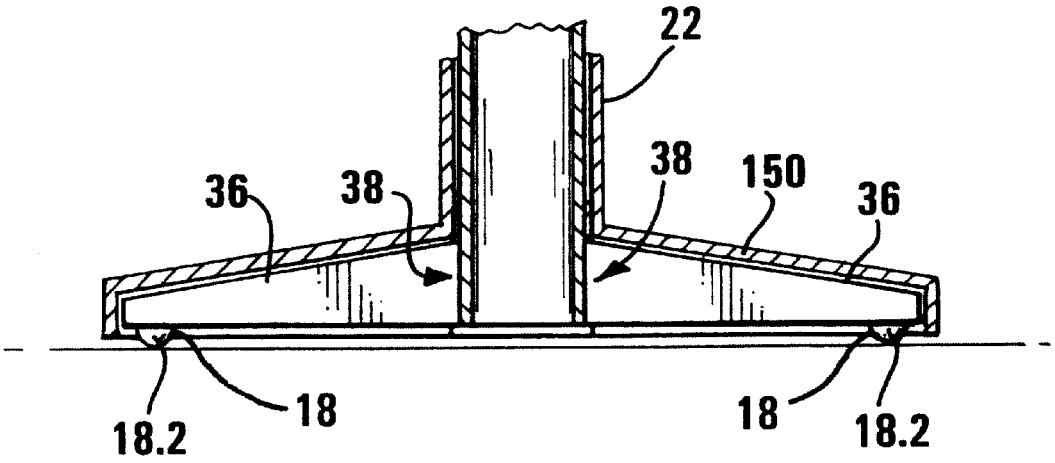
FIG. 9 shows a schematic, side sectioned view of covering elements of a stabilizing arrangement according to the invention.

In FIG. 9, reference numeral 150 indicates a cover, a pair of which is attached to the sleeve 22 of any of the previous embodiments. One cover 150 is shaped to cover each arm 36 and its associated foot 18.2. Furthermore, the covers 150 are shaped to appear substantially the same as the arms 28 and feet 18.1. Thus, the existence of the various arrangements described above will not be immediately apparent to a user.

Figure 10:
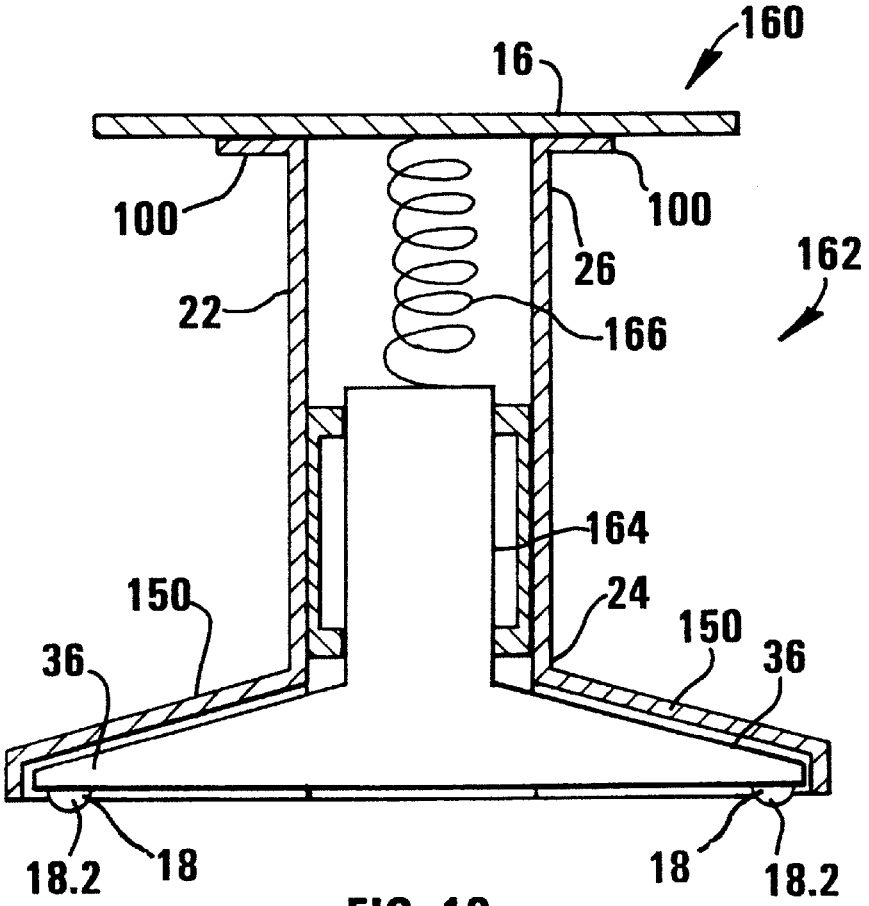
FIG. 10 shows a schematic, side sectioned view of a table having another embodiment of a stabilizing arrangement in accordance with the invention.

In FIG. 10, reference numeral 160 generally indicates a table having another embodiment 162 of a stabilizing arrangement according to the invention. The arrangement 162 is substantially the same as the arrangement 92. However, instead of the weight 94, the second support element, indicated at 164, is connected to the table top 16 via a spring 166. The spring 166 is configured to urge the support member 164 and thus the feet 18.2 into contact with the support surface. The support member 164 can be the weight 94 or simply a cylinder.

The arrangement 162 is shown incorporating the covers 150. As mentioned above, the covers 150 can be used with any of the previous embodiments.

Instead of protuberances 64, the displacement limiting means of the arrangement 162 includes a collar 180, which is fastened to an inner surface of the sleeve 22. An upper end 182 of the collar 180 has a lip 184 extending inwardly therefrom. A lower end 186 of the collar 180 also has a lip 188 extending inwardly therefrom. The lips 184 and 188 serve the same purpose as the protuberances 64 described earlier.

Figure 11:
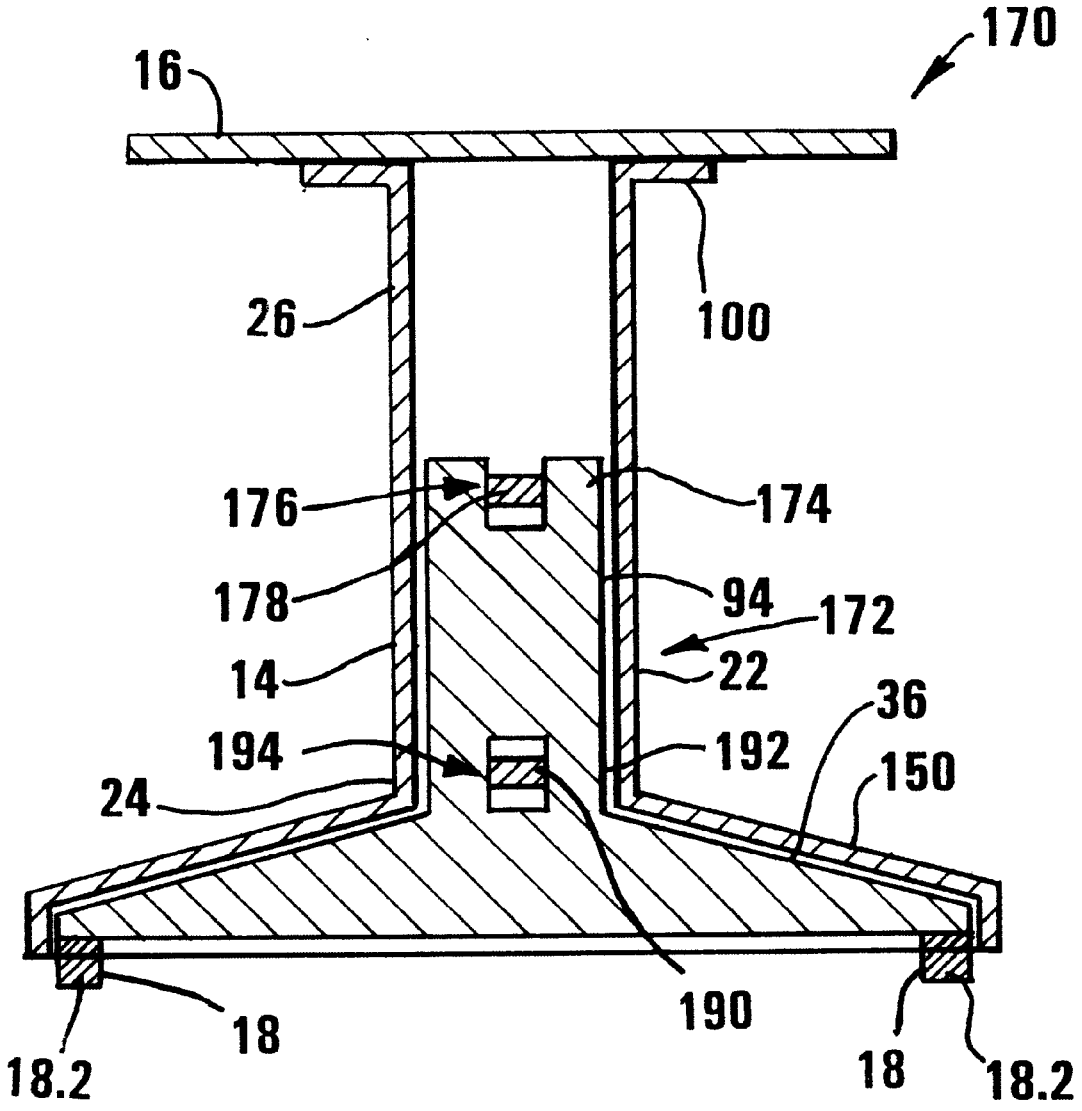
FIG. 11 shows a schematic, side sectioned view of a table having another embodiment of a stabilizing arrangement in accordance with the invention.

In FIG. 11, reference numeral 170 generally indicates a table having another embodiment 172 of a stabilizing arrangement in accordance with the invention.

The arrangement 172 is similar to the arrangement 92 shown in FIG. 4. The arrangement 172 does not, however, have the protruberances 64 to inhibit excessive relative linear displacement.

Instead, a first pin 178 and a second pin 190 are attached to, and extend between, opposed positions on the sleeve 22.

An upper end 174 of the weighted member 94 has a slot 176 defined therein. The pin 178 is positioned in the slot 176, by urging the pin 178 through diametrically opposed openings (not shown) defined in the sleeve 22 and through the slot 176. A lower end 192 of the weighted member 94 has an opening 194 defined therein. The pin 190 is positioned in the opening 194 by urging the pin 190 through diametrically opposed openings (not shown) defined in the sleeve 22 and through the opening 194.

As can be seen in FIG. 11, both the pins 178, 190, the slot 176, and the opening 194 have a rectangular cross section. The relative dimensions of the pin 178 and the slot 176, and the pin 190 and the opening 194 are such that, while a pair of opposed sides of each pin 178, 190 is substantially parallel to a pair of opposed sides of its associated slot 176 and opening 194 relative linear movement of the weight member 94 and the pins 178, 190 is permitted. The relative dimensions are such that, when angular movement of the weighted member 94 relative to the pins 178, 190 occurs, the pins 178, 190 jam in their respective slot 176 and opening 194, inhibiting linear movement.

It will readily be appreciated that, when all four feet 18 are on the support surface and a downward, off-center force is applied to the table top 16, angular movement of the weight 94 relative to the pins 178, 190 causes the weighted member 94 to lock frictionally in position relative to the sleeve 22.

The use of the pins 178, 190 facilitates manufacture of the arrangement 172 since accurate tolerancing is not required. Further, if the sleeve 22 is dented or otherwise damaged, the pins 178, 190 serve to retain the frictional engaging characteristics of the weight 94 and the sleeve 22 relative to each other.

It will readily be appreciated that the pins 178, 190, the slot 176 and the opening 194 can replace the protruberances 62, 64 in the other embodiments shown in the drawings.

The invention provides a stabilizing arrangement which is of a low manufacturing cost compared to other known stabilising arrangements and is therefore particularly suited for mass production and high quantity use.

What is claimed is:

1. A stabilizing arrangement for use with a table, the arrangement including:

a support structure, a table top being mountable on the support structure;

four feet which are mounted on the support structure so that a line drawn between a first pair of the feet intersects a line drawn between a second pair of the feet, the feet of each pair being fixed relative to each other with the pairs being linearly displaceable relative to each other; and a displacement means arranged on the support structure to permit linear displacement of the pairs of feet relative to each other, the displacement means being operable when the feet are placed on an uneven support surface so that all four feet can bear against the support surface, in use and;

a displacement limiting means which is operatively arranged with respect to the support structure and the feet and which is automatically frictionally operable to limit linear displacement of the pairs of feet relative to each other when all four feet bear against the support surface.

2. The arrangement as claimed in claim 1, in which the support structure includes a first and a second support member which are linearly displaceable with respect to each other, with the first pair of feet being fixed to the first support member and the second pair of feet being fixed to the second support member.

3. The arrangement as claimed in claim 2, in which the first support member is hollow and the second support member is received within the first support member.

4. The arrangement as claimed in claim 3, in which the first support member has covering elements extending therefrom, to cover the second pair of feet, the covering elements having an appearance similar to that of the first pair of feet.

5. The arrangement as claimed in claim 3, in which the first support member is fastenable to the table top.

6. The arrangement as claimed in claim 5, in which a mass of the second support member is such that contact of the second pair of feet with the support surface is facilitated.

7. The arrangement as claimed in claim 5, which includes a spring mounting means to permit the second support member to be spring mounted with respect to the table top to bias the second support member away from the table top.

8. The arrangement as claimed in claim 3, in which the displacement means is in the form of a lever mechanism which is arranged between the support members, the lever mechanism being configured so that, on movement of one of the support members towards the table top the other support member is urged away from the table top and vice versa, in use.

9. The arrangement as claimed in claim 8, in which the lever mechanism includes a lever member which is pivotally arranged, at one end, with respect to the first support member, and, at an opposed end, pivotally arranged with respect to the second support member, and a fulcrum member which is fastenable to the table top and which bears against the lever member at a position intermediate the ends of the lever member so that substantially an entire load carried by the table top bears on the lever arm, in use.

10. The arrangement as claimed in claim 3, in which one end of the first support member defines a tapered surface and one corresponding end of the second support member also defines a tapered surface, the tapered surfaces being configured so that when the ends of the members are adjacent each other, the surfaces together define a formation having a substantially "V"-shaped profile which opens towards an underneath surface of the table top, in use, at least one urging member being locatable in the formation, the, or each, urging member being configured so that, when a load is carried by the table top, on upward movement of the first member, the urging member bears against the tapered surface of the second member to urge the second member downwardly, and vice versa.

11. The arrangement as claimed in claim 3, in which the displacement limiting means includes relative configurations of the first and second support members which are such that linear displacement of the support members relative to each other is permitted when the support members are positioned substantially parallel to each other, but is inhibited when one of the support members is angled relative to the other support member.

12. The arrangement as claimed in claim 11, in which the displacement limiting means includes at least one frictional engaging formation which is defined on one of the support members, the, or each, engaging formation being configured so that, when the support members tilt relative to each other, the or each, engaging formation frictionally engages the other support member to inhibit linear displacement.

13. The arrangement as claimed in claim 3, in which the displacement limiting means includes two, spaced pins, a pin being received in each of a pair of spaced slots defined in the second support member.

14. A table comprising:

a table top;

a stabilizing arrangement, the arrangement including a support structure, which is mounted to the table top, the arrangement further including four feet mounted on the support structure so that a line drawn between a first pair of the feet intersects a line drawn between a second pair of the feet, the feet of each pair being fixed relative to each other with the pairs being linearly displaceable relative to each other;

a displacement limiting means arranged on the support structure for linear displacement of the pairs of feet relative to each other when the feet are placed on an uneven support surface so that all four feet can bear against the support surface, in use; and a displacement limiting means which is operatively arranged with respect to the support structure and the feet and which is automatically frictionally operable to limit linear displacement of the pairs of feet relative to each other when all four feet bear against the support surface.

* * * * *

UNITED STATES PATENT AND TRADEMARK OFFICE

CERTIFICATE OF CORRECTION

PATENT NO. : 6,209,465 B1
DATED : April 3, 2001
INVENTOR(S) : David Alan Brooks

It is certified that error appears in the above-identified patent and that said Letters Patent is hereby corrected as shown below:

Column 1,
Line 1, replace “stabilising” with -- stablizing --
Line 15, replace “utilise” with -- utilize --
Line 36, after “other” delete -- , --.

Column 4,
Line 15, replace “it” with -- It --.

Column 6,
Line 53, replace “stabilising” with -- stablizing --

Signed and Sealed this

Sixth Day of August, 2002

*Attest:*

*Attesting Officer*

JAMES E. ROGAN
*Director of the United States Patent and Trademark Office*